US012765664B2

(12) United States Patent
Gerhardt et al.

(10) Patent No.: US 12,765,664 B2
(45) Date of Patent: Oct. 20, 2026

(54) ORAL CARE DEVICE RECOMMENDATION SYSTEM

(71) Applicant: KONINKLIJKE PHILIPS N.V., Eindhoven (NL)

(72) Inventors: Lutz Christian Gerhardt, Eindhoven (NL); Quintin Oliver Williams, Eersel (NL); Rene Leonardus Jacobus Marie Ubachs, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 587 days.

(21) Appl. No.: 18/009,720

(22) PCT Filed: Jun. 7, 2021

(86) PCT No.: PCT/EP2021/065092
§ 371 (c)(1),
(2) Date: Dec. 10, 2022

(87) PCT Pub. No.: WO2021/249898
PCT Pub. Date: Dec. 16, 2021

(65) Prior Publication Data

US 2023/0240438 A1 Aug. 3, 2023

(30) Foreign Application Priority Data

Jun. 11, 2020 (EP) ..... 20179460

(51) Int. Cl.
*A46B 15/00* (2006.01)

(52) U.S. Cl.
CPC ..... *A46B 15/0012* (2013.01); *A46B 15/0006* (2013.01); *A46B 2200/1066* (2013.01)

(58) Field of Classification Search
CPC ..... A46B 15/0012; A46B 15/0006; A46B 15/0002; A46B 15/0004
See application file for complete search history.

(56) References Cited

U.S. PATENT DOCUMENTS 11,043,141 B2 * 6/2021 Gatzemeyer ..... A46B 15/0008
11,213,120 B2 * 1/2022 Gatzemeyer ..... A46B 15/0002
(Continued)

FOREIGN PATENT DOCUMENTS

WO 2018160986 A1 9/2018
WO 2022038023 A1 2/2022
WO 2022038028 A1 2/2022

OTHER PUBLICATIONS

International Search Report and Written Opinion Dated Aug. 18, 2021 for International Application No. PCT/EP2021/065092 Filed Jun. 7, 2021.

*Primary Examiner* — Michael D Jennings

(57) ABSTRACT

A computer-implemented recommendation system is for recommending a type of oral care accessory to be used with an oral care device. The recommendation takes account of oral geometry information in respect of a user and preferably also user behavioral information in respect of the manner in which the particular user conducts their oral care using the oral care device. The recommendation is based on the modelling of mechanical interactions between one or more oral care accessories of a set of oral care accessories and the oral geometry of the user when the user performs an oral care routine. From said modelling a cleaning metric is determined that represents the effectiveness of the oral care routine when using said one or more oral care accessories.

20 Claims, 9 Drawing Sheets

(56) References Cited

U.S. PATENT DOCUMENTS

| | | | | |
|---|---|---|---|---|
| 11,330,896 | B2 * | 5/2022 | Serval | A46B 15/0004 |
| 2009/0092955 | A1 * | 4/2009 | Hwang | G16H 20/40 434/263 |
| 2009/0215015 | A1 | 8/2009 | Chu | |
| 2012/0171657 | A1 | 7/2012 | Ortins et al. | |
| 2014/0345070 | A1 | 11/2014 | Miller et al. | |
| 2016/0135581 | A1 | 5/2016 | Pai | |
| 2018/0132602 | A1 * | 5/2018 | Gatzemeyer | A46B 15/0002 |
| 2020/0253702 | A1 * | 8/2020 | De Gentile | A46B 15/0012 |
| 2021/0235859 | A1 | 8/2021 | Farmah | |

* cited by examiner

ORAL CARE DEVICE RECOMMENDATION SYSTEM

This application is the U.S. National Phase application under 35 U.S.C. § 371 of International Application No. PCT/EP2021/065092, filed on Jun. 7, 2021, which claims the benefit of EP Application Serial No. 20179460.9, filed Jun. 11, 2021. These applications are hereby incorporated by reference herein.

FIELD OF THE INVENTION

This invention relates to oral care devices, such as toothbrushes, brushing mouthpieces and oral irrigation systems, and in particular, it relates to a system for recommending a type of oral care product or accessory such as a type of toothbrush head or a brushing arch of a mouthpiece.

BACKGROUND OF THE INVENTION

It is well-known that the cleaning efficacy of oral cleaning devices greatly depends on the cleaning technique of individuals as well as their tooth arch geometry.

Different users may require different oral care accessories for optimal performance. Such an oral care accessory may comprise a toothbrush head, a brush head with integrated nozzle, a multi-surface brush, a brushing mouthpiece, an irrigator nozzle, a brush head with light source/LED for tissue treatment during brushing etc.

For this reason, manual toothbrushes, as well as brush heads for electric toothbrushes, come in many different shapes and hardness/stiffness levels. Furthermore brushing mouthpieces may be provided in different sizes (arch width, length) or levels of clamping etc.) to cover a larger range of tooth and jaw archetypes of different populations. The clamping defines how much lateral and vertical force is exerted on the tooth when inserted into a biting tray of the mouthpiece.

However, users often do not know which oral care accessory, such as which brush head design or which toothbrush design, results in the best possible personal cleaning performance and user experience.

WO 2019/215447 discloses a smart toothbrush system which uses a true 3D representation of the user's teeth, and displays brushing data over a 3D representation of the user's teeth. This display provides feedback to the user for improving their brushing technique.

US 2012/171657 discloses another toothbrush with a display for displaying characteristics of the personal care regimen of the user.

SUMMARY OF THE INVENTION

The invention is defined by the claims.

According to examples in accordance with an aspect of the invention, there is provided a computer-implemented recommendation system for recommending a type of oral care accessory to be used as part of an oral care device, comprising:

an input for receiving input data comprising oral geometry information in respect of a user for whom an accessory is to be recommended; and a processor which is adapted to:

model the interaction between one or more oral care accessories of a set of oral care accessories, and the oral geometry of the user;

determine from said modelling a cleaning metric representing the effectiveness of the oral care routine when using said one or more oral care accessories; and based on said cleaning metric, provide a recommendation of a suitable oral care accessory, from the set of different oral care accessories, to be used with the oral care device.

The set of oral care accessories may comprise off-the-shelf products which can be purchased, or it may include designs created from a set of modular building blocks, which could then be manufactured.

This system provides a recommendation to a user as to the type of accessory to be used as part of an oral care device, based at least on the oral geometry of the user. In this way, improved oral care results are made possible by ensuring the most appropriate accessory is chosen for the particular user.

The oral geometry may relate to all teeth of the user, but it may instead relate to only a subset of teeth. For example, it may relate to a selected region of the jaw/arch or just one critical tooth geometry where typically poor cleaning is observed.

The system further comprises an input for receiving input data comprising user behavioral information in respect of the manner in which the particular user conducts their oral care using the oral care device, and the processor is adapted to model the interaction between the one or more oral care accessories and the oral geometry of the user when the user performs an oral care routine in said manner. This is of interest when the cleaning routine depends on the user's own technique, as is the case for a toothbrush or oral irrigation system. The recommendation is then based at least on the oral geometry of the user and their oral cleaning characteristics.

It is noted that the use of only oral geometry information could be of interest for a brushing mouthpiece system. The recommendation could then be the use of a particular size of mouthpiece (e.g. small, medium, large, extra large) with a certain brushing arch length and width, and tuft-to-tooth clamping.

The oral care accessory is for example a head (toothbrush head or flossing nozzle) of an oral care device (an electric toothbrush or oral irrigation system). The device thus has a handle to which the head is attached.

The interaction between all oral care accessories of the set and the user's oral geometry may be modelled, but instead only a sub-set of the oral care accessories may need to be modelled in order to find a suitable recommendation.

The cleaning metric is for example derived by modelling contact stresses between the oral cleaning accessory and the teeth. These contact stresses can be used to evaluate cleaning performance as well as the risk of damage to the teeth or gums.

Other cleaning metrics may be used such as frictional energy or power density or the time over which a certain stress is exerted on the tooth or biofilm surface. For example, the recommendation may be given to the user based on the cleaning efficacy evaluated based on a metric correlated to the removal of biofilm, plaque or other substance to be removed from the teeth. For example, the applied contact shear stress or force generated by the movement of the bristles or a fluid hitting the surface can be used as part of the sensor system, to enable a suitable recommendation to be generated (and provision of other advice, as discussed below).

The recommendation can be based on modelling the shear energy (sliding work) or frictional power. For example, a pressure threshold can be used to distinguish between cleaned and non-cleaned areas, where the thresholds can for example cover ranges of pressures such as <1 kPa, 1-10 kPa, 10-30 kPa, 30-50 kPa, and >50 kPa, depending on the material to be removed. This information can be translated into area fractions of cleaned teeth or percentages of clean tooth and then further be utilized in providing the recommendation, and/or other advice and feedback to the user. For example, a video animation of the person-specific simulated cleaning process can be send to an App of a user providing him indirect feedback or information on the effectiveness of the recommended or currently used brush head, and how the cleaning effectiveness will change if a different brushing technique (which is referred to as "behavioral information" in the text below) is used. It can also show the effect of the oral accessory (brush head) wearing out over time.

The system may comprise an input for receiving input data comprising medical information for the user. This medical information is for example not specific to the use of the device, and may comprise age, gender, and electronic medical record (EMR) information such as information on pregnancy or other comorbidities of relevance to oral healthcare. The EMR is for example accessible through a communication system to one or more databases of a hospital, insurance provider, dental provider, or government databases. For example, there may be oral health indices such as relating to plaque levels, stains, gum condition, halitosis. This information for example includes plaque maps (on top of the oral geometry information) or stain index images or other health related information such as pregnancy, gingivitis patient etc.

The system may comprise an input for receiving input data comprising operational information in respect of the oral care device. This operational information for example comprises, for an electric toothbrush, a frequency of operation, an amplitude of brush head motion, a frequency of brush head motion, or the time the frequency/motion is applied. For a flossing device, the operational information for example comprises a frequency of fluid jet pulses, a velocity of fluid jet pulses, a fluid flow rate and a fluid pressure. For an oral care device containing an additional radiofrequency (RF) generator circuit, the operational information may comprise a radiofrequency in the range of 100 kHz-300 GHz. For a brushing mouthpiece, this information may comprise a frequency of operation or motion pattern of the brushing arch or individual sub-segments of the brushing arch.

The operational information may also include information on different device settings used. For example, a user can select a certain cleaning mode on the device (deep clean, vs. sensitive gum). This will change the characteristics of the device, for example with different brushing motion generated by the device such as different sweeping amplitude or different actuation motion of the drive train with which the brush head oscillates.

The system may comprise an input for receiving input data comprising status information in respect of the oral care accessory. This status information relates to the condition of the oral care accessory, for example derived from one or more images of the oral care accessory taken during the course of use of the device. The status information, for a toothbrush head, for example relates to brush head geometry (including e.g. the material of the bristles, the geometry, the structure of the bristles), bristle layout, tuft layout, trim profile, changes in tuft geometry such as splaying due to wear out. It may relate to the condition of a toothbrush head generally or of the bristles of the toothbrush head. For a flossing device it may relate to the primary device functionality or a condition of the flossing or irrigation head or the jetting nozzle of the flossing or irrigation head (e.g. clogging of nozzle causing a rise in fluid pressure measured inside the device).

The processor may be further adapted to provide a recommendation of a suitable handle for the oral care accessory and/or suitable operating settings for the handle for the oral care accessory. Thus, the system can provide a recommendation for the most suitable combination of handle, operating settings and oral care accessory.

The oral geometry information for example comprises tooth geometry data derived from 2D or 3D tooth images. The tooth geometry data for example provides information such as identifying missing teeth and identifying dental implants and their locations. The system may comprise an input for receiving at least one input image from an image capture system, and the processor is adapted to process the image to derive the required oral geometry information to perform interaction modelling. Thus, the geometry information may be input to the system from an external source (e.g. an EMR database or from previous dental scan information) or it may be generated by the system using image analysis.

The tooth geometry data for example comprises tooth segmentation information or information on residual plaque and stain levels. Plaque or stain indices may be superimposed to the digital image or an image showing stained plaque and stain on teeth.

The system for example further comprises a database of data relating to the set of oral care accessories and/or the medical history of the user. For example, if the oral care accessory is a toothbrush head, the database may be of brush head geometries for different toothbrush heads and material properties and shapes of each filament or tuft used. The oral care accessory can then be matched to the user based on their geometry and care routine e.g. brushing characteristics. Thus, this data relates to the characteristics of the oral care accessory, such as design parameters and material properties.

The system may further comprise an input for receiving an image of the currently used oral care accessory, wherein the processor is further adapted to provide a recommendation of when to change the oral care accessory.

In this way, the system can advise the user on the type of oral care accessory to use as well as when to replace a worn-out accessory.

The processor may be further adapted to provide advisory information in respect of the user behavioral information. Thus, the system can function as a learning aid to improve the oral care routine, e.g. user's brushing technique, to achieve the best results.

In one example, the oral care accessory for example comprises a toothbrush head and the oral care device comprises an electric toothbrush having a handle to which the toothbrush head connects.

In this case, the user behavioral information may comprise one or more of:

brushing forces, brushing angles;

brushing speeds and motion patterns; and brushing location and time spend per location.

This information may be obtained using a sensor system which monitors motion directions and magnitudes (e.g. using an accelerometer arrangement) and forces (e.g. using a pressure or force sensor).

In another example, the oral care accessory comprises a brushing arch and the oral care device comprises a mouthpiece toothbrush comprising a handle to which the brushing arch is to be connected.

The invention also provides an oral care system comprising:

- a handle having a drive mechanism and a connection interface for connecting an oral care accessory to the handle;
- a recommendation system as defined above; and
- at least one oral care accessory as recommended by the recommendation system.

The recommendation system may be implemented on a device remote to the main body, such as a mobile telephone or tablet or a cloud-based server.

The oral care accessory or the handle of the oral care device for example comprises a sensor system for providing sensor information from which the behavioral information can be derived.

The sensor system for example comprises one or more of:

- a force measurement system;
- a brushing angle measurement system;
- a motion detection system;
- a location measurement system.

Part or parts of the sensor system may be decoupled from the oral care device, for example motion detection using optical motion tracking.

The invention also provides a computer-implemented method for recommending a type of oral care accessory to be used with an oral care device, comprising:

- receiving input data comprising oral geometry information in respect of a user for whom an accessory is to be recommended;
- receiving input data comprising user behavioral information in respect of the manner in which the particular user conducts their oral care using the oral care device;
- modelling the interaction between one or more oral care accessories of a set of oral care accessories (or a building set thereof) and the oral geometry of the user when the user performs an oral care routine in said manner;
- determining from said modelling a cleaning metric representing the effectiveness of the oral care routine when using said one or more oral care accessories; and
- based on said cleaning metric, providing a recommendation of a suitable oral care accessory, from a set of different oral care accessories, to be used with the oral care device.

The method may be implemented by a computer program running on the device itself or remote devices or a cloud-based platform which can connect to other systems (e.g. digital manufacturing systems or hospital suites or insurance and provider platforms).

These and other aspects of the invention will be apparent from and elucidated with reference to the embodiment(s) described hereinafter.

BRIEF DESCRIPTION OF THE DRAWINGS

For a better understanding of the invention, and to show more clearly how it may be carried into effect, reference will now be made, by way of example only, to the accompanying drawings, in which.

DETAILED DESCRIPTION OF THE EMBODIMENTS

Figure 1:
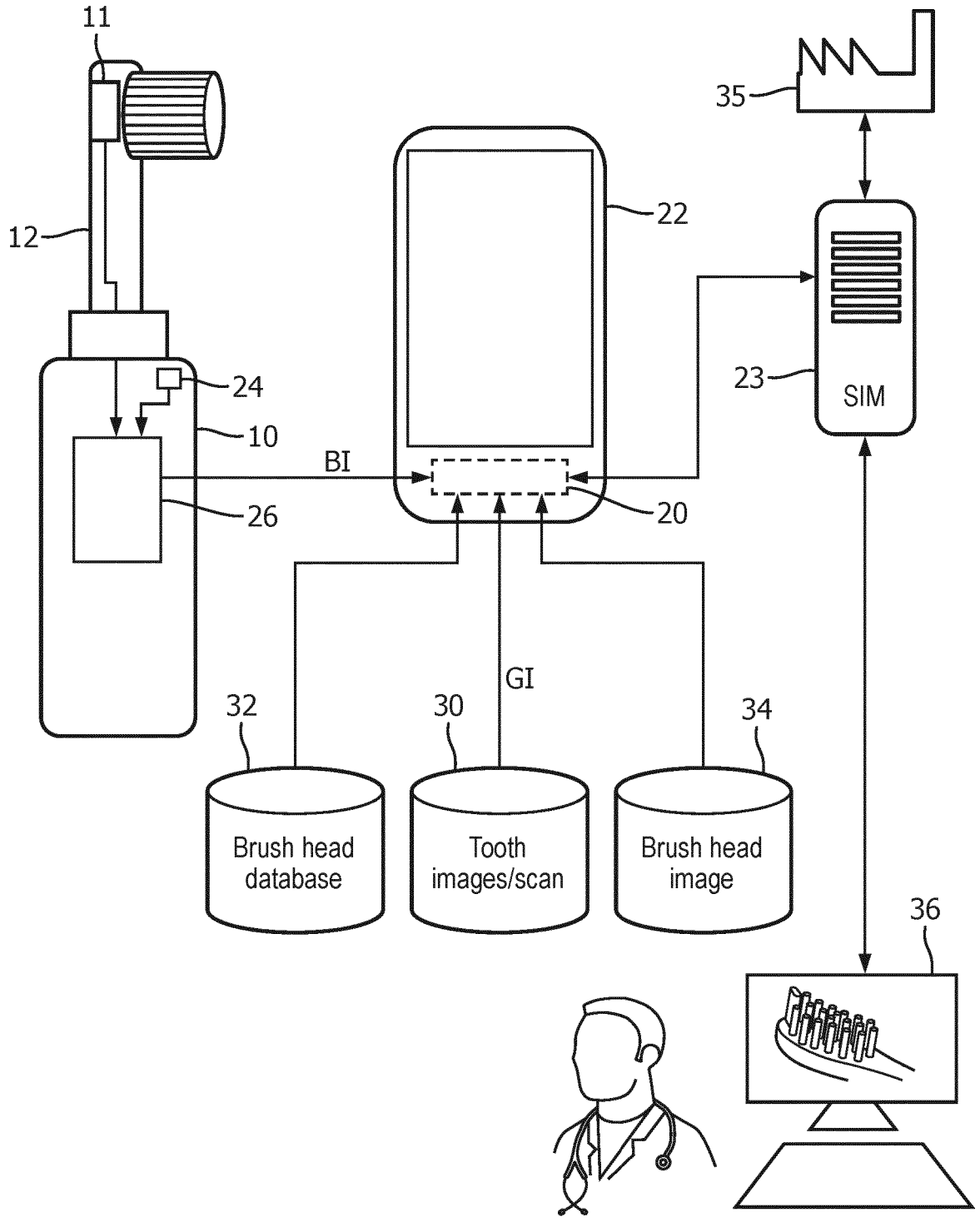
FIG. 1 shows an oral care system.

The invention will be described with reference to the Figures.

It should be understood that the detailed description and specific examples, while indicating exemplary embodiments of the apparatus, systems and methods, are intended for purposes of illustration only and are not intended to limit the scope of the invention. These and other features, aspects, and advantages of the apparatus, systems and methods of the present invention will become better understood from the following description, appended claims, and accompanying drawings. It should be understood that the Figures are merely schematic and are not drawn to scale. It should also be understood that the same reference numerals are used throughout the Figures to indicate the same or similar parts.

The invention provides a computer-implemented recommendation system for recommending a type of oral care accessory to be used in combination with an oral care device. The recommendation takes account of at least oral geometry information in respect of a user and preferably also user behavioral information in respect of the manner in which the particular user conducts their oral care using the oral care device.

The oral geometry information can, for example, be obtained through optical intra-oral scanning or via CT, MRI, etc. When user behavioral information is also used, it can be obtained by optical measurements with multiple cameras or through the use of a sensorized toothbrush, which for example measures forces and acceleration using embedded force cells and accelerometers.

FIG. 1 shows an oral care system which comprises an oral care device 10 and an oral care accessory 12 to be used with the oral care device.

The invention will be described in detail with reference to an oral care system in the form of an electric toothbrush together with a recommendation system. Thus, the oral care device 10 in this case comprises an electric toothbrush handle and an oral care accessory 12 in the form of a toothbrush head. However, any other attachable oral care accessory may be considered such as irrigator nozzle, brush head with integrated nozzle or light source (or any other sensor or actuator), or (partial) cleaning mouthpieces (brushing arch).

The system also has a computer-implemented recommendation system for recommending a type of oral care accessory, e.g. toothbrush head, to be used by a particular user.

The recommendation system of FIG. 1 is implemented by various components. In the example shown, the processing is carried out at multiple sites, including a local processor 20 which is the processor of a mobile phone 22 on which an app is loaded to implement the recommendation system, and a remote external processor 23. The external processor can may be implemented on any other remote device such as a tablet or workstation or in the cloud as a data (analysis) engine.

The processing described may however be implemented in different ways, with a different division of processing between the oral care device itself, a local device of the user (e.g. the mobile phone) and the external processor. The oral care device may only serve to collect sensor data, and that data is processed somewhere else, or alternatively some of the sensor data processing may take place at the oral care device itself.

One example will be described based on the architecture shown in FIG. 1, purely by way of example The mobile phone receives usage information from the oral care device, i.e. the toothbrush handle 10 in this example, relating to user behavioral information in respect of the manner in which the particular user conducts their oral care using the oral care device, i.e. how they brush their teeth. This applies to a toothbrush example, but this information may not be needed for a mouthpiece implementation which performs hands-free cleaning. The usage information also enables the position and/or orientation measurement of the toothbrush head relative to the teeth to be determined. For an oral irrigation system, the user behavioral information may relate to the path followed by accessory, the timings of the accessory at different locations along the path, and the angle of the accessory over time at the different locations along the path.

This information is for example obtained by a pressure or force sensor 11 mounted in the toothbrush head 12 (or handle) and a motion and angle sensor 24 such as three axis accelerometer and/or a three axis gyroscope. The motion sensor is in the handle in this example but can be also inside the brush head (or other attachable cleaning or treatment units).

The pressure sensor may also be in the handle, and the coupling between the handle and the toothbrush head provides usage information which correlates with the pressure applied to the teeth or gums.

As a minimum, the normal force vector (i.e. reaction force component that is perpendicular to platen of the tooth brush head) is measured by the pressure or force sensor. When combined with (i) brushing dynamics related information (oscillation amplitude and speed of brush head, motion/speed of brush head along the tooth arch), (ii) the location and/or orientation of the toothbrush head at that particular (contact) time, and (iii) the position relative to the oral geometry of the user, the interaction between the toothbrush head and the tooth or gum surfaces can then be modelled.

The user behavioral information which be derived from the sensor information for example comprises one or more of:

brushing forces,
brushing angles;
brushing speeds; and
location and/or motion measurements.

Location and motion may be obtained by a tracking and measurement system (e.g. an optical measurement system or inertial measurement unit; IMU).

The sensor system may also or instead have an external optical measurement system. Motion or location tracking for example may be implemented using reflective markers attached to the oral care device and the user's face and captured using cameras, or derived from accelerometer, tooth geometry and location data.

As a minimum, the behavioral information may indicate a level of force applied by the user during their oral care routine.

A short range transmitter 26 (e.g. Bluetooth or Zigbee) transmits the behavioral information (BI) to the mobile phone via a short range receiver (not shown), where it functions as one input to the processor 20.

The processor 20 has another input for receiving oral geometry information in respect of a user for whom an accessory is to be recommended.

In one example, the oral geometry information is 3D scan data 30 received from an external database, which is for example populated by a dentist when an oral scan is prepared.

In other example, the oral geometry information is extracted from 2D images. These may again be stored in a remoted database, but they may equally be generated by a camera of the mobile phone or by a special 3D camera for insertion into the mouth cavity fitted to a pole, which is activated within the oral cavity to capture 3D images. Oral scan data may for example be used as an input to a finite element or computer vision fitting algorithm to determine the cleaning efficacy.

The system may be used for recommending a pre-existing oral care accessory design. In this case, a database 32 is also provided of data relating to a set of oral care accessories, components and material properties thereof. For the example of toothbrush heads, the database stores information relating to geometries for different toothbrush heads, for example tens of different toothbrush head designs, optionally from different manufacturers. The toothbrush head can then be matched to the user based on their geometry and care routine e.g. brushing characteristics.

The system may, as an optional additional feature, define an ideal oral care accessory, for example based on the modelling of brush head designs generated by selected building blocks (building sets which when assembled together will form a semi-customized brush head design) so that eventually a user-specific design can be manufactured. This option is discussed further below.

To enable a recommendation to be made, the external processor 23 is used to perform cleaning efficacy simulations based on the information sources described above.

In particular, the interaction between an oral care accessories and the oral geometry of the user is modelled, based on the way the user performs their oral care routine. From this modelling, a cleaning metric can be derived representing the effectiveness of the oral care routine when using said one or more oral care accessories. A recommendation of a suitable oral care accessory to be used, from a set of different oral care accessories, is then provided.

In this example, the external processor 23 processes the geometry information and the user behavioral information thereby to provide this recommendation of a suitable oral care accessory from the set of pre-defined different oral care accessories. There is also the optional additional feature of designing an ideal oral care accessory by a design optimization process using predefined building blocks and building sets which when assembled together form a brush head. Such an optimal personalized design may be then provided to a digital manufacturing plant 35, or shared with a connected platform or system 36 of a dental professional, insurance or oral care provider for example to obtain endorsement, or enable policy negotiations for subscription models allowing them to track progress of oral health conditions or oral care compliance when the new brush head is used.

An animation of the optimal cleaning technique may also be generated, e.g. by the external processor 23, for display to the user on the mobile phone 22. These simulations may include user feedback relating to the expected cleaning performance of the brush head on the oral geometry of the user.

FIG. 1 also shows that the processor 20 has a third input for receiving an image 34 of the currently used oral care accessory. The processor may then be further adapted to provide a recommendation of when to change the oral care accessory. This image may be taken using the mobile phone, periodically, such as every week or every two weeks. In this way, the system can advise the user on the type of oral care accessory to use as well as when to replace a worn accessory.

In addition to recommending a suitable accessory e.g. brush head, the system may also analyze the brushing performance and provide advisory information (e.g. a tutorial when needed) in respect of the user behavioral information. Thus, the system can function as a learning aid to improve the oral care routine, e.g. brushing technique, to achieve the best results.

The brushing behavior improvement may be achieved by recommending a reduction in force, a brushing angle change (increase or decrease), a longer brushing time, or a personalized device firmware update. The brushing behavior recommendation may be given by mapping of the actual and ideally intended brushing behavior (forces, angles, speeds, time per tooth location) onto the digitized personal dentition information and running sensitivity analyses for critical brushing factors (i.e., computational modelling and simulations of interactions with different factors and settings) and providing the user with feedback as to how this affects the predicted cleaning performance of his chosen brush head.

There may be brush head designs which are optimized for specific populations (e.g. for the Asian market). The information gathered by the system may be used for giving additional advice, such as advice for a best fitting mouthpiece, a most appropriate whitening treatment plan which gives protection of the gum line (masking) or local light activation through contour scanning.

The processing of the geometry information and the behavior information for example involves determining contact stresses to the teeth so that the cleaning performance as well as the risk of damage to the teeth or gums can be assessed.

For the example of a toothbrush, a bristle reach contact stress model may be used for this purpose. This provides modelling of the interaction between the bristles and the teeth. An equivalent interaction model may be used for other types of oral care devices.

As discussed above, a recommendation can be based on modelling of how the user performs their cleaning routine (e.g. brushes or cleans or flosses) in combination with general and/or specific characteristics of the teeth and mouth. The outcome of the oral care routine can be optimized by varying certain parameters, e.g. brush head type, trim profile, brushing speed, force, brushing angles, time spend on each tooth element.

The software algorithms and models implemented by the processor 23 are used to assess the brush head cleaning efficacy and enable performance prediction simulations.

The recommendation is for example based on a bristle reach and contact stress model The inputs for the recommendation system comprise:

(i) A digital geometric model (CAD) or oral scan data sets of the subject's dentition. This can for example be obtained via intra-oral scanning or by first creating a mold of the dentition and creating a digital model from the scan or the mold, or from images/scans derived from sensor-based feedback. The scanning of the dentition and/or production of the models only has to be performed once, and can be performed either at a dentist's office or at a brush head resale point. This can also be done at home using dedicated equipment or via a smart phone extension or via a built-in camera system in the brush head.

(ii) User specific brush handling data, such as orientation, force and movement. This data can be generated by a suitably sensorized brush head and/or brush handle, possibly in combination with external hardware, such as a camera or motion tracking system.

(iii) Data related to the oral cleaning device: geometry, design limits, frequency, amplitude, material properties, etc.

The system then makes use of a computational model using the subject-specific input in order to calculate the cleaning efficacy. The model can then be adapted to optimize efficacy. Variables that can be optimized can either be related to the brush head or the user handling technique or both. The model takes into account the relevant physics related to cleaning of the teeth through brushing, e.g. bending of bristles, contact and friction between bristles and between the bristles and teeth and gums.

An example of such a model is a finite element model which is a widely used method for numerically solving partial differential equations. In such a model, the bristles may be described using beam or solid elements. The bristles are attached on the relevant side to a virtual platen that can be modelled as a deformable solid or a rigid body. This system is then brought into contact with a virtual oral geometry, consisting of at least teeth and gingiva (gum tissue). Through the use of a suitable contact algorithms, the interaction between the bristles themselves and between the bristles and the dentition can be described. The contact algorithm will provide a contact force vector for each pair of discrete pieces of the model that are in contact.

This oral geometry can be described as deformable solid or rigid elements using finite elements. The behavior of the bristles is then determined by the prescribed movement of the platen, the constitutive model which relates strains to stresses for the various materials involved, and the contact algorithms and their parameter values, e.g. friction coefficient.

Instead of prescribing movement of the platen, its location and orientation can also be modelled as being a function of applied user force, and other personal user parameters, such as brushing speed and brush handle angle.

From such a model, various information can be obtained, such as the shear stress applied to the tooth surface by the bristles moving over it, the dynamic movement and resulting reach of the bristles, amount of splay of bristles due to the applied user force.

Next to the finite element method other methods or a combination thereof may be used to solve the mathematical equations describing the physics involved in oral cleaning, e.g. finite volume method, smoothed particle hydrodynamics, discrete element method, etc. Depending on the relevant physics to be described, a combination of methods may be used, e.g. to describe fluid-structure interactions.

The cleaning efficacy is evaluated based on a metric correlated to the removal of biofilm, plaque or other substance to be removed from the teeth. For example, the (maximal) applied contact shear stress or force generated by the movement of the bristles may be determined.

Another example of a metric could be the shear energy or frictional power that (a part of) a single bristle has exerted on a location on the tooth surface. Alternatively, the total shear energy exerted by all (parts of) bristles that have been in contact with the particular location on the tooth surface. In another example, a pressure threshold can be used to distinguish between cleaned and non-cleaned areas, wherein the thresholds cover ranges of pressures such as <1 kPa, 1-10 kPa, 10-30 kPa, 30-50 kPa, and >50 kPa, depending on the material to be removed.

Figure 2A:
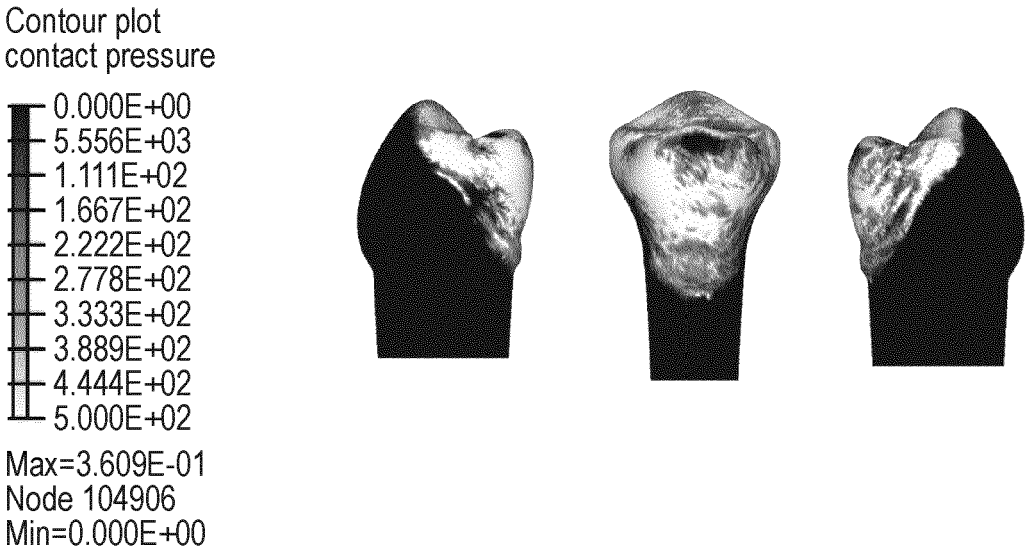
FIG. 2 shows an example of contact stress distributions for a pre-molar tooth geometry calculated as part of simulation results for four different designs of toothbrush with respect to a model of the user's teeth.
Figure 2A:
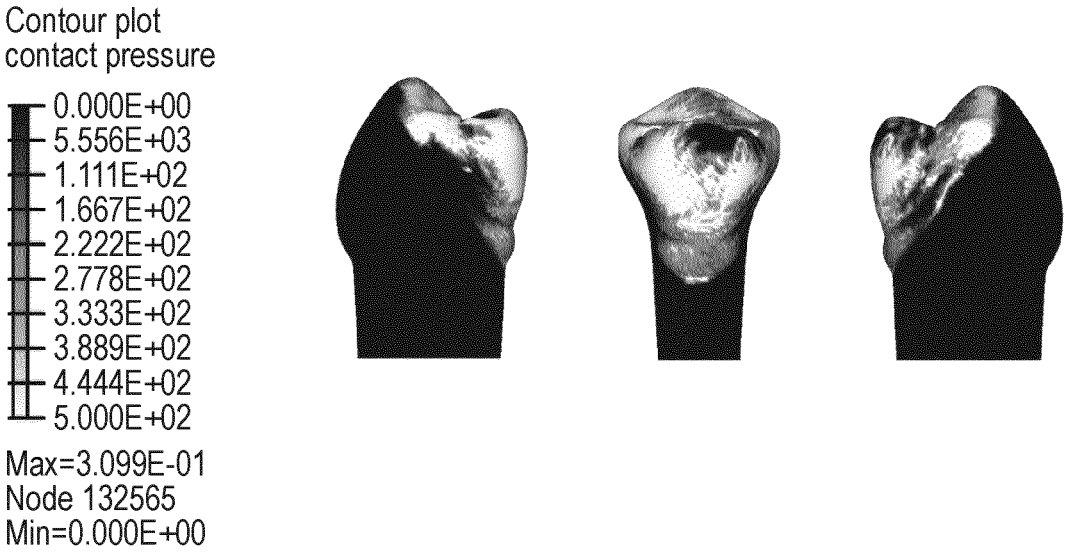

FIG. 2 shows four examples of contact stress distributions for a pre-molar tooth geometry calculated as part of simulation results for four different designs of toothbrush with respect to a model of the user's teeth.

Figure 2B:
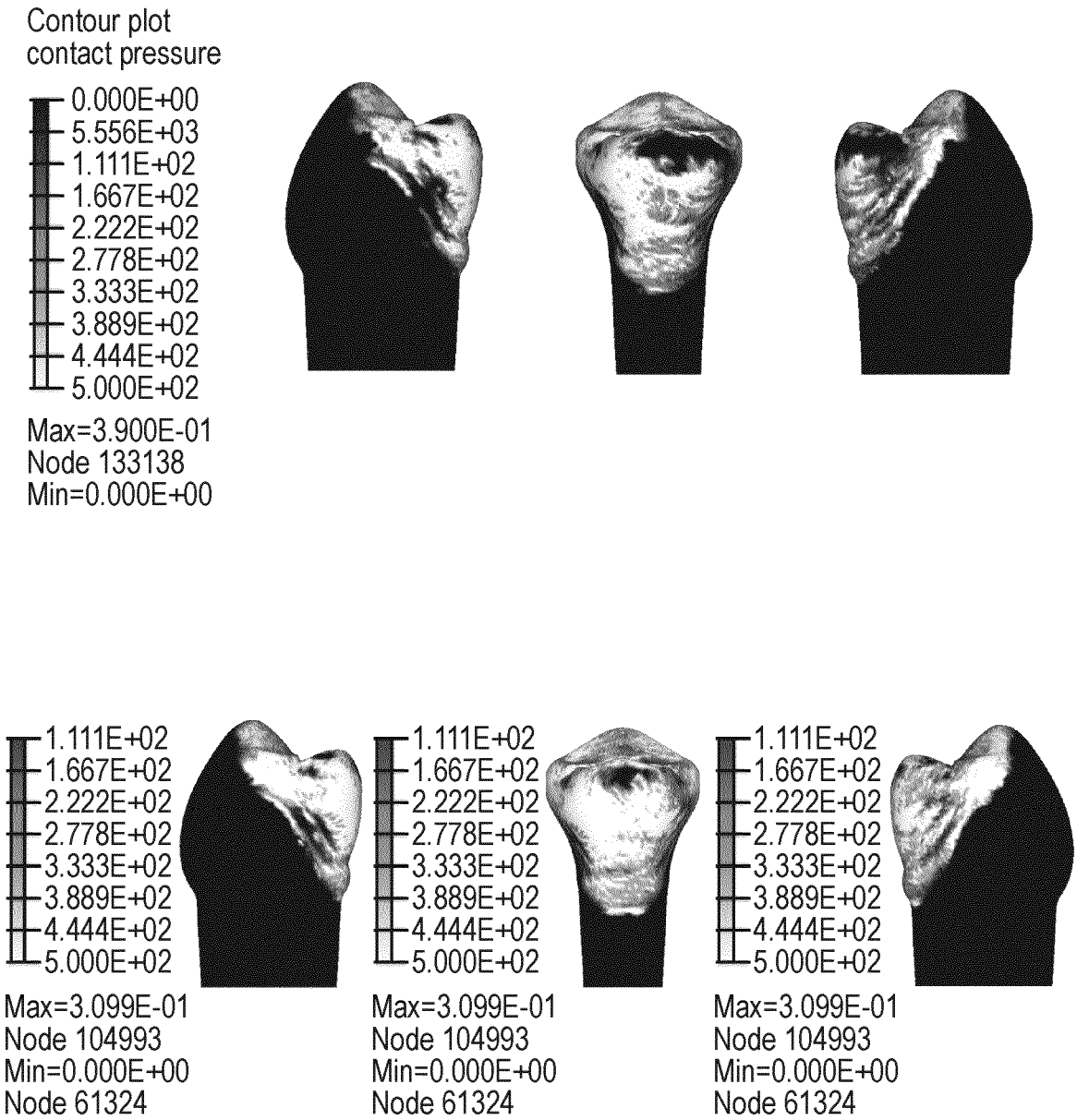

FIG. 2A shows the results for two toothbrush designs and FIG. 2B shows the results for two further two brush designs. The data sets of FIG. 2 are examples of so-called heat maps (or contour plots) showing the contact stress distribution on the tooth surface. They are the result of a virtual brushing session, where a finite element model of a brush head is moved over a virtual dentition via a certain path, using a certain orientation and force load. By solving the mathematical equations describing the physics, the contact stresses that have occurred over time between the bristles and the tooth surface can be found.

When the contact stress values are above zero, there has been contact between the bristles and the tooth surface. By tracking these locations, the reach of a brush head can be determined. Reach is the first requirement for cleaning. Higher values indicate that the contact has been more intense. For the removal of plaque ideally the stress values are in a certain range; too low and the plaque layer is not affected, too high and the plaque layer is disturbed or removed, but in addition the tooth surface can be damaged. Furthermore, too high contact stress values on the gingiva are a metric for discomfort.

Contact stress thresholds may for example be set as limits which the recommended brush head should not exceed. A minimum tangential contact stress threshold may also be set (or other metrics such as frictional energy, or frictional power density, or pressure which is exerted over a certain time period) to ensure plaque removal and thereby determine cleaning efficacy.

The output of the system may comprise:

(i) Personalized directions (angle/force/movement/position) to use during brush head handling during brushing to improve cleaning efficacy. Thus, the system can provide feedback on how to improve cleaning;

(ii) Recommendation of an optimal off-the-shelf brush head based on the current handling profile. The system can select a specific cleaning head for a specific tooth geometry (molar, premolar, incisor) or tooth region such as interdental, at gum line or facial sides, or for a specific dentition geometry (e.g., with missing teeth, crooked teeth);

(iii) Recommendation of an optimal off the shelf brush head with improved recommended handling profile.

(iv) As an optional additional function of the system (in addition to enabling selection from an off-the-shelf set of existing brush heads), a personalized semi-custom brush head design is possible from predefined building sets which when assembled by either the user or a software algorithm (based on oral geometry features) form a full brush head for which a recommendation interaction simulation is performed. This for example involves defining an optimized trim profile (i.e. bristle field geometry) for a personalized brush head, and optimizing the brush head geometry, tuft layout, materials and building blocks/sets for digital manufacturing.

(v) Determine when part of an oral cleaning appliance needs replacement.

(vi) Select a specific handle (i.e. the oral care device main appliance) for the head.

Figure 3:
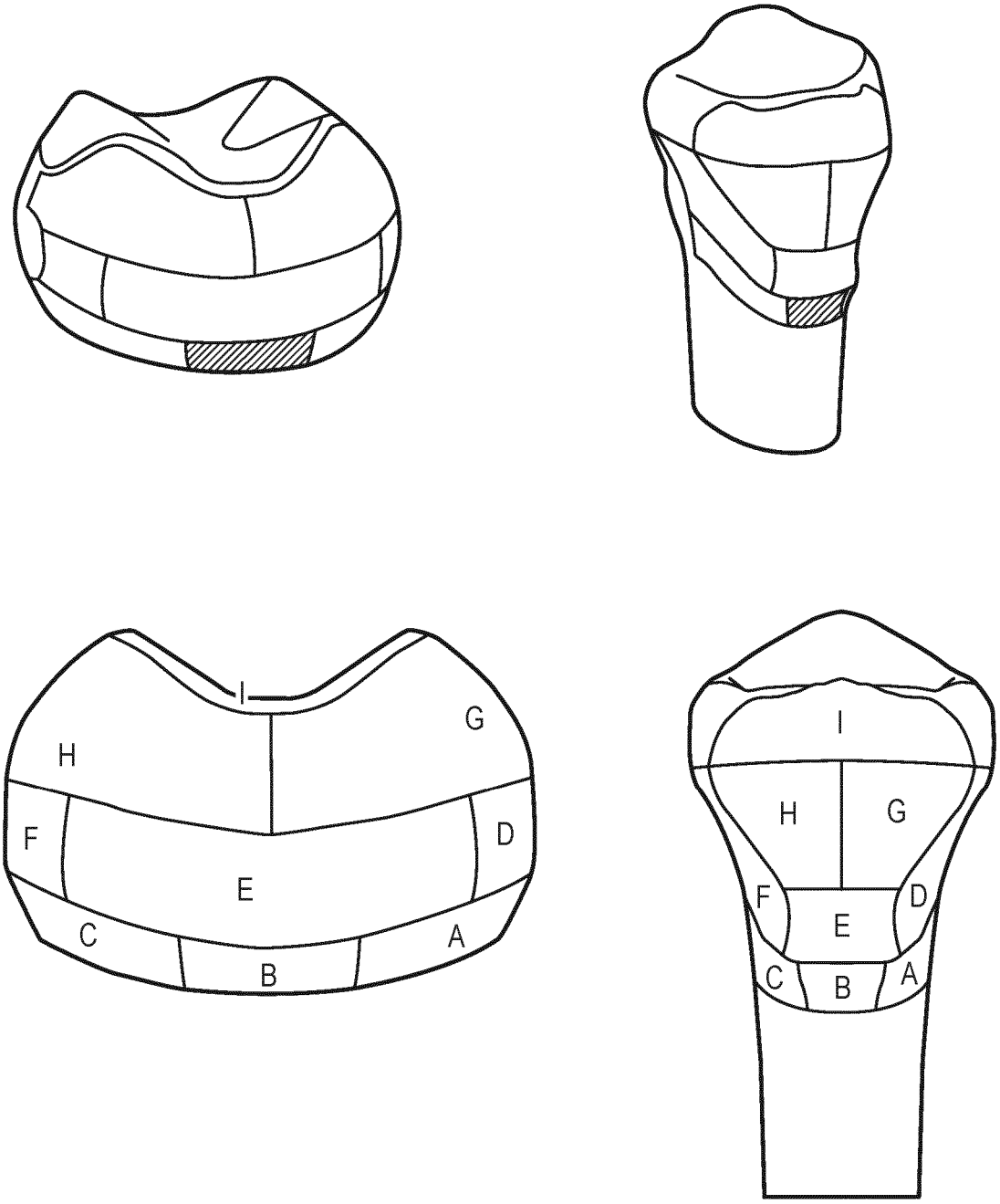
FIG. 3 shows two different tooth geometries divided into regions of interest for cleaning.

FIG. 3 shows schematics of a molar tooth geometry in the left column and a pre-molar tooth geometry in the right column delineated into segments according to the Rustogi classification which is used to assess plaque removal efficacy of tooth brushes at different tooth regions/areas.

The division into regions based is on a synthetic tooth model generated on the basis of input data. The segmentation is used for reach and plaque removal scoring, enabling cleaning efficacy to be quantified for separate areas. Different brush heads can then be compared based on efficacy on gum line, interdental and total tooth area cleaning capabilities with respect to the model of the users teeth. A naming convention for those regions is shown. The interdental regions between two teeth are segments D and F, the regions at the gum line are segments A, B, C. The facial sides are divided into regions E, G, H, I.

A more person-specific, or bespoke, brush head can be designed that takes into account the tuft spacing, length, size, angle, material, tufted area size and shape, trim profile, etc. It is also possible to suggest an optimal handle or setting for a specific user when the handle is capable of applying different movement patterns to an attached accessory.

In an example, the external processor 23 implements a computational model to determine the at least one oral care cleaning optimization comprising a simulation of an interaction of a synthetic version of an oral care accessory (cleaning unit) with the oral geometry information, in particular digitized geometry data of the teeth and/or digitized geometry data of the mouth (which form part of the oral geometry information). The external processor may further perform simulations of interactions of synthetic versions of a plurality of different oral care accessories with this digitized geometry data. Thus, a synthetic or virtual version of an oral care accessory has an interaction simulated with the teeth and/or mouth of a user in order to determine an oral care cleaning optimization, which can involve a number of simulations of different oral care accessories or assemblies of different building sets.

These simulations of the interaction of the synthetic version of the oral care accessory or accessories with the digitized geometry data of the teeth and/or mouth may be based on one or more of:

- the determined user-specific behavioral information of the user;
- status information in respect of the functional performance of the oral care accessory;
- the operational information (frequency, amplitude etc.) of the oral care accessory.

In this manner, the modelling, such as an algorithm implemented by the external processor 23, can take into account how the user actually cleans their teeth.

The simulations may provide a determination of at least one metric used as an oral care accessory performance index to indicate or determine the oral care cleaning optimization.

Thus, a cleaning metric or metrics is or are used in determining the oral care cleaning optimization.

The metric can be calculated based on modelling of a synthetically generated toothbrush (or oral irrigator or flossing device or combined toothbrush and flossing device, or other oral cleaning device) with a synthetic model of the teeth, dentition and/or mouth which is a representation of the user's teeth, dentition and mouth. Such modelling can be used to determine different metrics for different oral care accessories used in different ways for the user, which can account for how the user actually cleans their teeth (i.e. how they have been cleaning their teeth previously), or how they could clean their teeth.

Thus, metrics calculated in this way can be used to select the best oral care accessory for the user, select the best way of cleaning their teeth, select combinations of elements to form an ideal cleaning system for the user, and provide advice on how they could improve their teeth cleaning. An optimization is thereby performed for a particular user relating to which oral care accessory to use, and which an oral cleaning device, and relating to how the user could better improve their oral care routine.

As mentioned above, the modelling can be used in the generation of a design of an oral care accessory that is ideally suited to the user. In other words, an optimized digital design can be generated through computational simulations of interactions between modelled oral care accessories and modelled teeth and/or the mouth.

The oral geometry information of the teeth of the user and/or the geometry data mouth of the user may comprise one or more of:

- size of different teeth;
- shape of different teeth;
- curvature of dentition;
- size of mouth;
- shape of mouth;
- orientation of different teeth;
- orientation of one or more implants;
- presence or absence of teeth at specific locations in the mouth;
- presence or absence of implants at specific locations in the mouth;
- appearance and geometry of gum line (width, thickness of gums, geometry of pockets).

This geometry data of the teeth and/or mouth is for example derived from one or more images of the teeth and/or mouth of the user and/or is derived from information provided by a dental practitioner and/or is derived from data acquired during at least one oral care cleaning session of the user.

Figure 4:
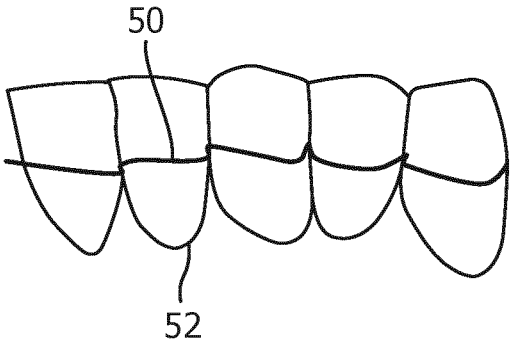
FIG. 4 shows a 2D tooth surface line and a gum line which may form part of the geometry information.

FIG. 4 shows a 2D tooth surface line 50 and a gum line 52 which may form part of the geometry data.

Figure 5:
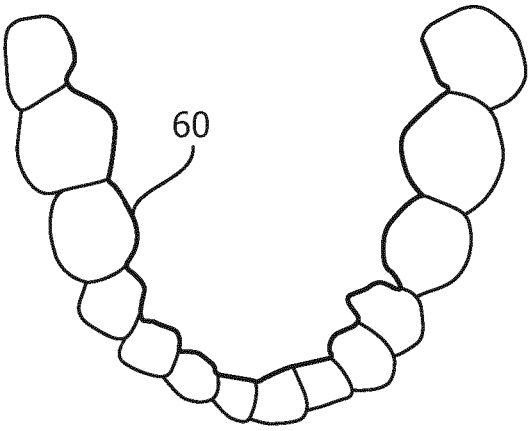
FIG. 5 shows a 2D tooth surface line denoting the innermost extent of the teeth, which may again be used as part of the geometry information.

FIG. 5 shows a 2D tooth surface line denoting the innermost extent of the teeth 60 (which is the lingual tooth line), which may again be used as part of the geometry data.

Figure 6:
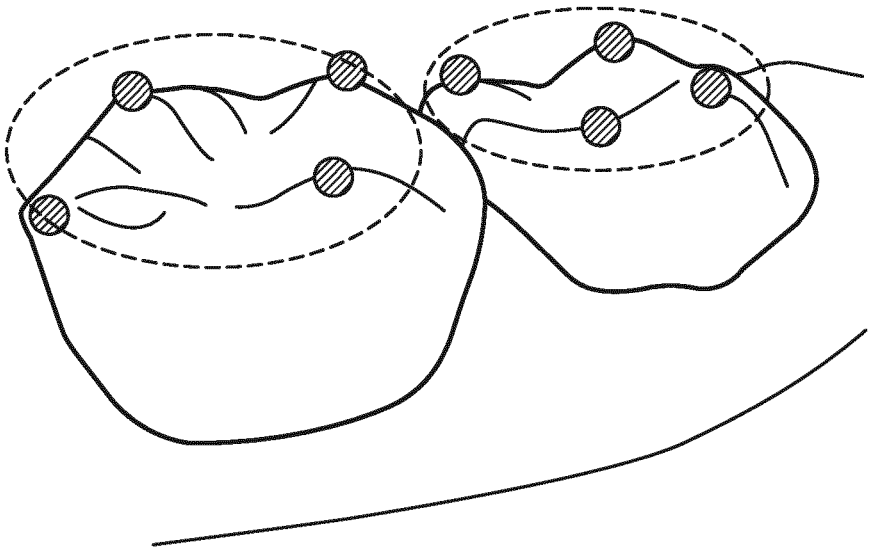
FIG. 6 shows landmarks of individual teeth that may also form part of the geometry information.

FIG. 6 shows landmarks on individual teeth which may also form part of the geometry data. The geometry information may be derived from a 3D scan (or from 2D tooth images) or from dental impression, scans or plaster molds. The geometry data for example comprises tooth segmentation information and landmark locations and statistics.

Figure 7:
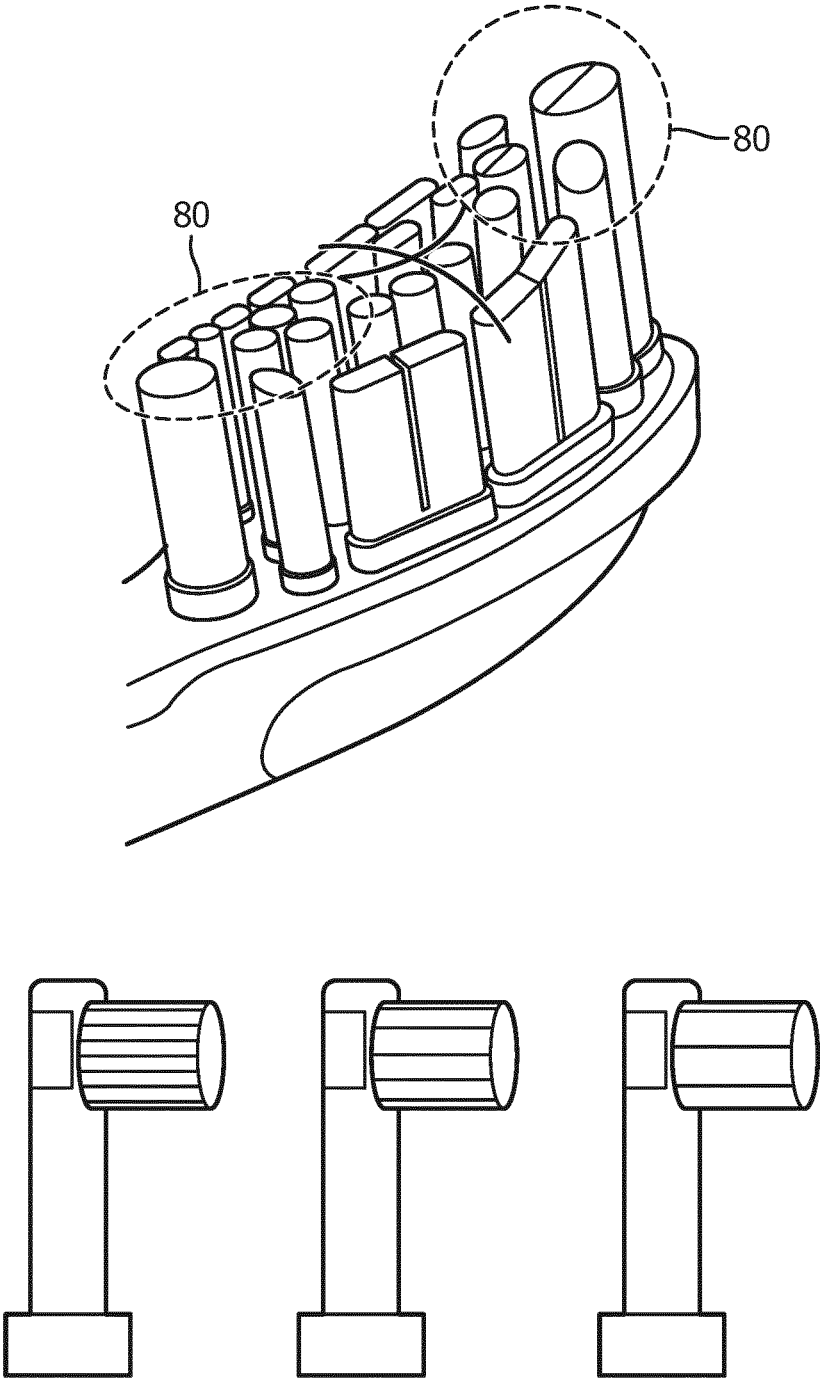
FIG. 7 shows a toothbrush head and a set of toothbrush heads with different designs.

FIG. 7 shows at the top a toothbrush head. The design is characterized by geometry information (e.g. trim profile and layout such as tuft size, length, area, bristle field area and tuft density) and material information (e.g. bending stiffness, Poisson's ratio). The toothbrush head for example has key zones 80. A set of three different toothbrush heads is schematically shown at the bottom of the figure. This represents in simplified schematic form different brush head designs.

As mentioned above, the user behavioral information for example comprises one or more of brushing forces, brushing angles and brushing speeds, for example relating to the motion along the tooth arch.

Figure 8A:
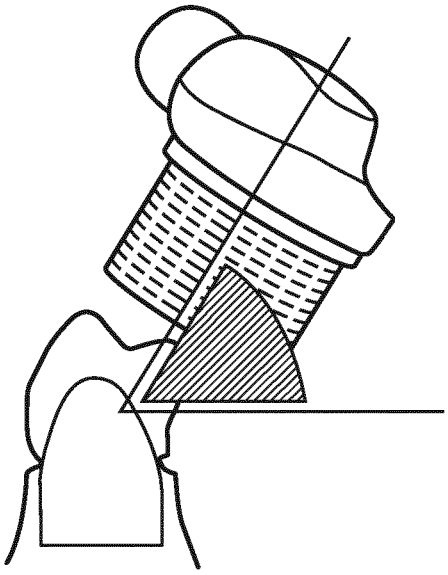
FIG. 8*a* shows the roll angle.

FIG. 8*a* shows a first brushing angle which is relevant; the roll angle, i.e. the rotation angle around the long axis of the toothbrush handle.

Figure 8B:
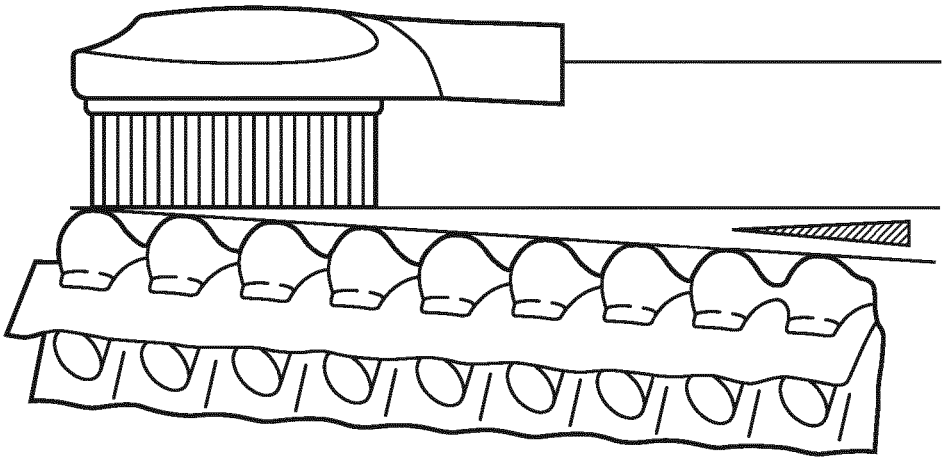
FIG. 8*b* shows the pitch angle and FIG. 8*c* shows the yaw angle.

FIG. 8*b* shows a second brushing angle which is relevant; the pitch angle, i.e. the rotation angle around the first short axis of the oral care device inducing a lifting or tilting motion of the brush head relative to the tooth surface.

Figure 8C:
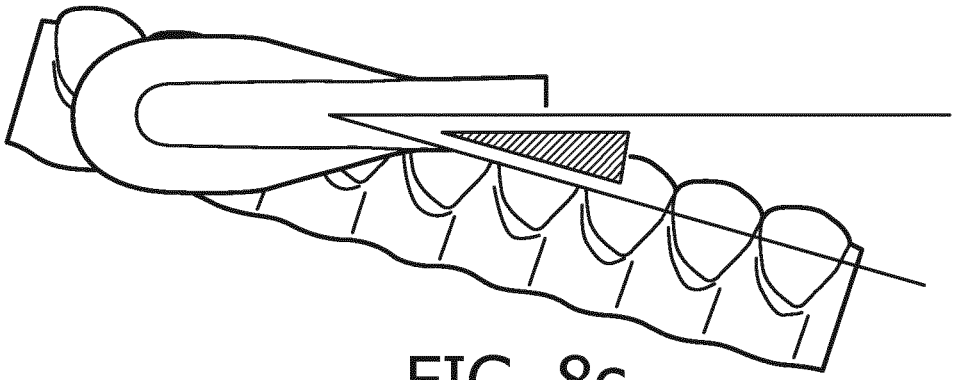

FIG. 8*c* shows a third brushing angle which is relevant; the yaw angle, i.e. the rotation angle around the second short axis of the oral care device inducing an in-plane rotation or twisting motion of the brush head on the tooth surface.

The roll angle describes the rotation angle around the long axis of the tooth brush handle or brush head, whereas the pitch and yaw angle describe rotations around axes that are perpendicular to the axis of the roll angle.

As explained above, one example of the invention enables actual (or alternatively ideal) brushing behavior, in terms of forces, angles and speeds) and brush head geometries (trim profile, layout, materials) to be combined to create a personalized solution.

One possible goal may be to predict a best performing brush head for a particular gum line or interdental arrangement, the most critical tooth region or geometry of a user (molar, pre-molar, incisor, canine, upper or lower jaw) based on historical medical data such as plaque maps or images, or for overall cleaning. The best performing brush head may be selected from a list of existing brush heads, based on parametric fitting, feature extraction and/or contact stress mapping as explained above.

Another possible goal may to be predict a best performing brush head for different teeth (molar, pre-molar, incisor, canine) which may reflect the most critical tooth regions of a user.

Another possible goal may be to define an optimum ideal trim profile for a personalized brush head (based on modelling results of semi-customized brush heads enabled through the modular design approach by building sets). The design may be optimized based on geometry and/or materials. Digital manufacturing may then be used to create the optimized brush head.

Another possible goal is to provide advice on brushing behavior and to optimize brushing behavior through coaching.

The system may have a learning capability, whereby the system can be trained to predict how the brushing behavior may change for a new design and take this change into account in the simulation and selection of the personalized brush heads. The modelling system can comprise a machine learning element such as a neural network that has been trained on data in order to determine this information. This departs from the conventional assumption that brushing behavior is independent of the brush head design.

Another goal is to provide replacement advice. A simulation may be carried out based on an up to date image of the toothbrush head, with a used and splayed brush head, to indicate whether replacement is needed.

A further input which may be provided to the recommendation system is an indication of actual cleaning performance resulting from a particular oral care routine. For example, a staining solution may be used to show visually the areas that are clean and the areas that are not. Images of the oral area with such a staining solution applied may then be processed by the system to provide feedback in respect of the actual cleaning performance.

The invention includes at least the ability to recommend a best existing accessory e.g. toothbrush head from a pre-defined set of available models or pre-defined sets of modular building blocks which when arranged together from a brush head. Each of these may be modelled in the software so the cleaning performance can be evaluated.

Figure 9:
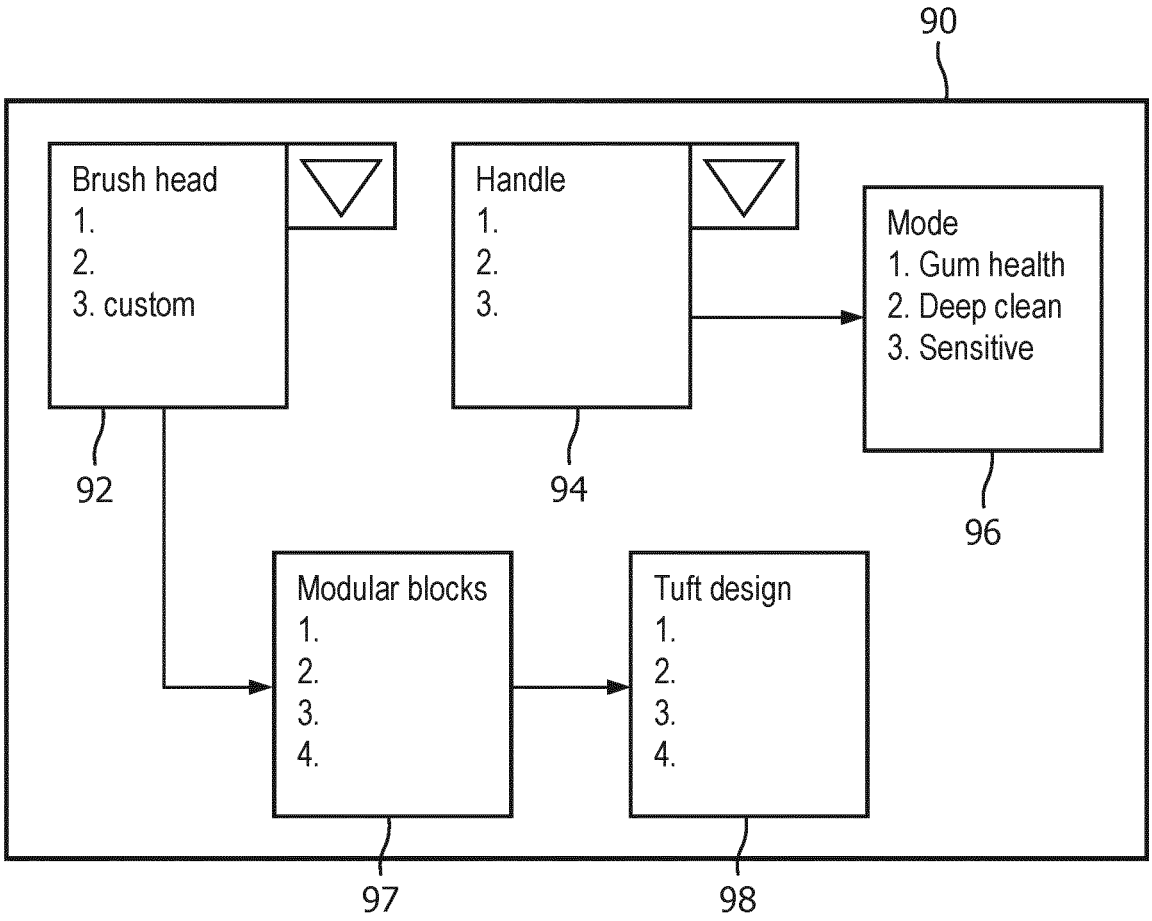
FIG. 9 shows how a smartphone App may use a reference database for recommending an oral care accessory or handle or both based on interaction modelling.

FIG. 9 is used to explain the modular design approach mentioned above, wherein design building blocks are generated, for example for a toothbrush relating to different tuft types, lengths, patterns etc. Then, a new design may be created based on a modular approach, either automatically or by a user design which can be generated by the user himself in a suitable App.

FIG. 9 shows a reference database, in this case relating to oral care accessory comprising a toothbrush head. There is a list 92 of standard brush head designs, and the option to add a customized version to the list. The items in the list may be accessed by a drop down menu function provided with the App.

There is also a list 94 of handle options. An operating mode may also be selected for the chosen handle from a list 96. The operating modes for example enable the user to select general cleaning aim, for example to improve gum health, for a deep clean or a sensitive tooth clean option.

For creating a customized brush head, a list 97 of modular blocks may be used. These are design modules which may be combined, such as tuft layouts in different regions of a toothbrush head. The more detailed tuft design features (such as material types or other mechanical characteristics) may also be selected from a list 98. These modules may enable a user to provide a first guess estimation selection using the drop down menus. The user selects a combination of brush head and handle features (which could be the currently used handle and brush head) and obtains a recommendation on whether the selection is the best choice for them, based on the interaction modelling explained above. If not, the best alternative choice is provided again based on interaction modelling.

A user-designed modular version may then be manufactured as shown in FIG. 1.

Figure 10:
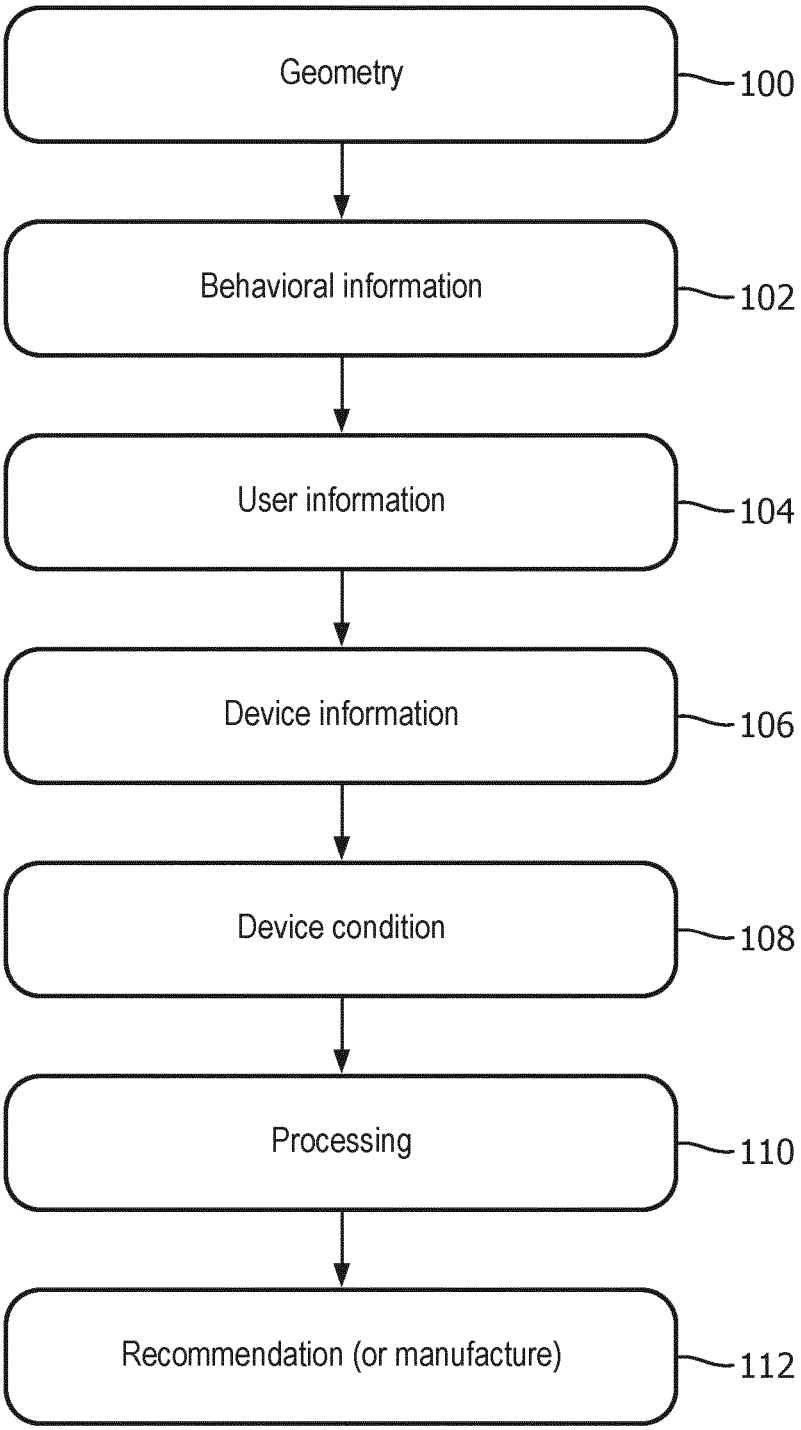
FIG. 10 shows a computer-implemented method for recommending a type of oral care accessory to be used with an oral care device.

FIG. 10 shows a computer-implemented method for recommending a type of oral care accessory to be used with an oral care device. Examples are given for a brush head but the invention is also applicable for brushing mouthpieces, combined brushing and flossing brush heads having a fluid-emitting nozzle, or any other oral care accessory.

In step 100, oral geometry information is received in respect of a user for whom an accessory is to be recommended.

In step 102, user behavioral information is received in respect of the manner in which the particular user conducts their oral care using the oral care device.

In step 104, general user-related information is received, not necessarily specific to oral care, such as age, gender, medical records such as missing teeth or whether some dental implants are present at some locations. Any information related to the health status of the user may be taken from an EMR (Electronic medical record). Oral health indices for plaque, stain, gingival, halitosis can also be used as input.

In step 106 device operational data is received such as the frequency of operation; type of brush head motion (oscillation, rotation-oscillation, sweeping, tapping and combinations thereof) amplitude of brush head motion; frequency of brush head motion; frequency of fluid jet pulses; velocity of fluid jet pulses; fluid flow rate; fluid pressure; setting of RF generator.

In step 108 oral care accessory operational and/or status information is received, such as condition information of the oral care accessory derived from one or more images of the oral care accessory. This condition information may be based on brush head geometry data; bristle layout; tuft layout; trim profile; tuft geometry changes over time, tuft color changes. A measure may be derived of the condition of a toothbrush head or brushing mouthpiece, the condition of bristles of a toothbrush head or brushing mouthpiece, the condition of a flossing/irrigation head or the condition of a jetting nozzle of a flossing/irrigation head. Brush head geometry data can include the material of the bristles, geometry, structure of the bristles.

The use of some or all of these information sources may be implemented by the system.

In step 110, the available information, which comprises at least the oral geometry information, is processed, thereby to provide a recommendation of a suitable oral care accessory, from a set of pre-defined different oral care accessories, to be used with the oral care device. The additional option is to provide a user-specific design for manufacture.

In step 112, the recommendation is provided as an output to the user or else as manufacturing instructions.

The invention has been described in connection with a toothbrush system. However, it may be applied to a fluid flossing system, wherein different nozzle designs are possible, and a recommendation is presented for the most appropriate nozzle design.

As mentioned above, a machine learning algorithm may be used to provide a more accurate and reliable recommendation (or user-specific design). A machine-learning algorithm is any self-training algorithm that processes input data in order to produce or predict output data. Here, the input data comprises the oral geometry information and the behavioral information and the output data comprises the output recommendation.

The software platform (connected ecosystem) can be trained using (real-time) brushing behavioral information (forces, speeds, angles, time spend on each location) acquired with different existing brush heads during the course of use of the brush. It can for example be assumed that brushing behavior is constant throughout the typical use time of a brush head (3 months) and independent of brush head design chosen or selected by the platform. To accommodate for these assumptions (if not fully valid), simulations can be 'adjusted' to the current brush behavior (e.g. if the brush wears out, the user may be applying more forces). This is for example applicable to simulations regarding replacement advice.

Moreover, continuous training of the system with brushing behavioral information obtained with different brush heads (many consumers often use different brush heads), can enable to predict how the brushing behavior may change for a new design and take this change into account in the performance prediction simulation and recommendation or selection of the (personalized) ideal brush.

The behavioral information may be the raw movement and force information, or it may be pre-processed to derive contact stress levels or a contact stress map. The geometry information is for example data concerning the gum line and/or the tooth segmentations.

Suitable machine-learning algorithms for being employed in the present invention will be apparent to the skilled person. Examples of suitable machine-learning algorithms include decision tree algorithms and artificial neural networks. Other machine-learning algorithms such as logistic regression, support vector machines or Naïve Bayesian model are suitable alternatives.

The structure of an artificial neural network (or, simply, neural network) is inspired by the human brain. Neural networks are comprised of layers, each layer comprising a plurality of neurons. Each neuron comprises a mathematical operation. In particular, each neuron may comprise a different weighted combination of a single type of transformation (e.g. the same type of transformation, sigmoid etc. but with different weightings). In the process of processing input data, the mathematical operation of each neuron is performed on the input data to produce a numerical output, and the outputs of each layer in the neural network are fed into the next layer sequentially. The final layer provides the output.

Methods of training a machine-learning algorithm are well known. Typically, such methods comprise obtaining a training dataset, comprising training input data entries and corresponding training output data entries. An initialized machine-learning algorithm is applied to each input data entry to generate predicted output data entries. An error between the predicted output data entries and corresponding training output data entries is used to modify the machine-learning algorithm. This process can be repeated until the error converges, and the predicted output data entries are sufficiently similar (e.g. ±1%) to the training output data entries. This is commonly known as a supervised learning technique.

For example, where the machine-learning algorithm is formed from a neural network, (weightings of) the mathematical operation of each neuron may be modified until the error converges. Known methods of modifying a neural network include gradient descent, backpropagation algorithms and so on.

The training input data entries correspond to example the oral geometry and behavior information, and historical data (geometry, material of previously used brush heads) and the training output data entries correspond to the recommendations or oral care accessory characteristics.

As discussed above, the system makes use of processor to perform the data processing. The processor can be implemented in numerous ways, with software and/or hardware, to perform the various functions required. The processor typically employs one or more microprocessors that may be programmed using software (e.g., microcode) to perform the required functions. The processor may be implemented as a combination of dedicated hardware to perform some functions and one or more programmed microprocessors and associated circuitry to perform other functions.

Examples of circuitry that may be employed in various embodiments of the present disclosure include, but are not limited to, conventional microprocessors, application specific integrated circuits (ASICs), and field-programmable gate arrays (FPGAs).

In various implementations, the processor may be associated with one or more storage media such as volatile and non-volatile computer memory such as RAM, PROM, EPROM, and EEPROM. The storage media may be encoded with one or more programs that, when executed on one or more processors and/or controllers, perform the required functions. Various storage media may be fixed within a processor or controller or may be transportable or available in the cloud, such that the one or more programs stored thereon can be loaded into a processor.

Variations to the disclosed embodiments can be understood and effected by those skilled in the art in practicing the claimed invention, from a study of the drawings, the disclosure and the appended claims. In the claims, the word "comprising" does not exclude other elements or steps, and the indefinite article "a" or "an" does not exclude a plurality.

A single processor or other unit may fulfill the functions of several items recited in the claims.

The mere fact that certain measures are recited in mutually different dependent claims does not indicate that a combination of these measures cannot be used to advantage.

A computer program may be stored/distributed on a suitable medium, such as an optical storage medium or a solid-state medium supplied together with or as part of other hardware, but may also be distributed in other forms, such as via the Internet or other wired or wireless telecommunication systems.

If the term "adapted to" is used in the claims or description, it is noted the term "adapted to" is intended to be equivalent to the term "configured to".

Any reference signs in the claims should not be construed as limiting the scope.

The invention claimed is:

1. A computer-implemented recommendation system for recommending a type of oral care accessory to be used as part of an oral care device, comprising:

a first input for receiving input data comprising oral geometry information in respect of a user for whom an oral care accessory is to be recommended;

a second input for receiving input data comprising user behavioral information in respect of the manner in which the particular user conducts their oral care using the oral care device with an oral care accessory; and a processor which is adapted to:

model the interaction between one or more oral care accessories of a set of oral care accessories, and the oral geometry of the user when the user performs an oral care routine in said manner;

determine from said modelling a cleaning metric representing a model-derived quantitative measure of predicted cleaning performance for the modelled interaction between the one or more oral care accessories and the oral geometry of the user; and based on said cleaning metric, provide a recommendation of a suitable oral care accessory, from the set of different oral care accessories, to be used with the oral care device.

2. The system of claim 1, comprising an input for receiving input data comprising medical information of the user.

3. The system of claim 1, comprising:

an input for receiving input data comprising operational information in respect of the oral care device; and/or an input for receiving input data comprising status information in respect of the oral care accessory; and/or an input for receiving an input image from an image capture system, and wherein the processor is adapted to process the image to derive the oral geometry information.

4. The system of claim 1, wherein the processor is further adapted to provide a recommendation of a suitable handle for the oral care accessory and/or suitable operating settings for the handle for the oral care accessory.

5. The system of claim 1, further comprising a database of data relating to a set of oral care accessories.

6. The system as claimed in claim 1, further comprising an input for receiving input data comprising an image of the currently used oral care accessory, wherein the processor is further adapted to provide a recommendation of when to change the oral care accessory.

7. The system as claimed in claim 1, wherein the processor is further adapted to provide advisory information in respect of user behavioral information.

8. The system as claimed in claim 1, wherein the oral care accessory comprises a toothbrush head and the oral care device comprises an electric toothbrush comprising a handle to which the toothbrush head is to be connected.

9. The system as claimed in claim 8, wherein the user behavioral information comprises one or more chosen from the group of:

brushing forces, brushing angles;

brushing speeds; and brushing location and time spend per location.

10. The system as claimed in claim 1, wherein the oral care accessory comprises a brushing arch and the oral care device comprises a mouthpiece toothbrush comprising a handle to which the brushing arch is to be connected.

11. An oral care system comprising:

a handle having a drive mechanism and a connection interface for connecting an oral care accessory to the handle;

a recommendation system as claimed in claim 1; and at least one oral care accessory as recommended by the recommendation system.

12. The oral care system as claimed in claim 11, wherein the oral care accessory or the handle of the oral care system comprises a sensor system for providing sensor information from which the behavioral information can be derived, wherein the sensor system comprises one or more of:

a force measurement system;

a brushing angle measurement system;

a motion detection system; and a location measurement system.

13. The system of claim 1, wherein the oral geometry information comprises digitized geometry data of the user's teeth and/or mouth derived from 2D or 3D images or intraoral scanning.

14. The system of claim 1, wherein the modeling comprises a physics-based simulation including a bristle reach and contact stress model, and wherein the cleaning metric is determined from at least one of contact stress, applied contact shear stress, shear energy, frictional energy, frictional power, frictional power density, pressure exerted over a time period, and a cleaned tooth area fraction determined using a pressure threshold.

15. A computer-implemented method for recommending a type of oral care accessory to be used with an oral care device, comprising:

receiving input data comprising oral geometry information in respect of a user for whom an oral care accessory is to be recommended;

receiving input data comprising user behavioral information in respect of the manner in which the particular user conducts their oral care using the oral care device with an oral care accessory;

modelling the interaction between one or more oral care accessories of a set of oral care accessories and the oral geometry of the user when the user performs an oral care routine in said manner;

determining from said modelling a cleaning metric representing a model-derived quantitative measure of predicted cleaning performance for the modelled interaction between the one or more oral care accessories and the oral geometry of the user; and based on said cleaning metric, providing a recommendation of a suitable oral care accessory, from a set of different oral care accessories, to be used with the oral care device.

16. A computer program comprising computer program code means which is adapted, when said program is run on a computer, remote device or on a cloud-based platform, to implement the method of claim 15.

17. The computer program of claim 16, wherein the modeling comprises a physics-based simulation including a bristle reach and contact stress model, and wherein the cleaning metric is determined from at least one of contact stress, applied contact shear stress, shear energy, frictional energy, frictional power, frictional power density, pressure exerted over a time period, and a cleaned tooth area fraction determined using a pressure threshold.

18. The computer program of claim 16, wherein the oral geometry information comprises digitized geometry data of the user's teeth and/or mouth derived from 2D or 3D images or intraoral scanning.

19. The method of claim 15, wherein the oral geometry information comprises digitized geometry data of the user's teeth and/or mouth derived from 2D or 3D images or intraoral scanning.

20. The method of claim 15, wherein the modeling comprises a physics-based simulation including a bristle reach and contact stress model, and wherein the cleaning metric is determined from at least one of contact stress, applied contact shear stress, shear energy, frictional energy, frictional power, frictional power density, pressure exerted over a time period, and a cleaned tooth area fraction determined using a pressure threshold.

* * * * *